US010196944B2

(12) United States Patent
Evans et al.

(10) Patent No.: US 10,196,944 B2
(45) Date of Patent: Feb. 5, 2019

(54) MECHANICAL LASH CONTROL FOR A SWITCHABLE ROLLER FINGER FOLLOWER

(71) Applicant: Schaeffler Technologies AG & Co. KG, Herzogenaurach (DE)

(72) Inventors: Matthew Evans, Warren, MI (US); Debora Manther, Royal Oak, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 452 days.

(21) Appl. No.: 14/876,039

(22) Filed: Oct. 6, 2015

(65) Prior Publication Data

US 2016/0102584 A1 Apr. 14, 2016

Related U.S. Application Data

(60) Provisional application No. 62/062,503, filed on Oct. 10, 2014.

(51) Int. Cl.

| | |
|---|---|
| ***F01L 1/22*** | (2006.01) |
| ***F01L 1/18*** | (2006.01) |
| ***F01L 13/00*** | (2006.01) |

(52) U.S. Cl.

CPC ..... *F01L 1/22* (2013.01); *F01L 1/185* (2013.01); *F01L 13/0005* (2013.01); *F01L 13/0036* (2013.01); *F01L 2001/186* (2013.01); *F01L 2103/00* (2013.01); *F01L 2105/00* (2013.01); *F01L 2820/01* (2013.01); *Y10T 74/20882* (2015.01)

(58) Field of Classification Search

CPC ... F01L 13/0005; F01L 1/185; F01L 13/0036; F01L 2105/00; F01L 1/22; Y10T 74/20882

See application file for complete search history.

(56) References Cited

U.S. PATENT DOCUMENTS

| | | | | |
|---|---|---|---|---|
| 6,314,928 | B1 * | 11/2001 | Baraszu ..... | F01L 1/185 123/198 F |
| 7,174,869 | B2 | 2/2007 | Proschko et al. | |
| 7,909,007 | B2 | 3/2011 | Manther et al. | |

(Continued)

FOREIGN PATENT DOCUMENTS

| | | |
|---|---|---|
| WO | 2008068251 | 6/2008 |
| WO | 2014071373 | 5/2014 |

*Primary Examiner* — Mark A Laurenzi
*Assistant Examiner* — Wesley G Harris
(74) *Attorney, Agent, or Firm* — Volpe and Koenig, P.C.

(57) ABSTRACT

A switchable finger follower, including an inner lever and an outer lever. The outer lever is mounted for pivoting movement to the inner lever. A coupling device is located on one of the inner or outer levers and has a locking pin arranged to move between a locking position, in which the inner and outer levers are connected together for movement in an activation direction, and an unlocked position, in which the inner lever is pivotable relative to the outer lever. A coupling projection is located on the other of the inner or outer lever. The locking pin engages beneath the projection in the locking position, and the locking pin includes a flat at a defined flat height that contacts the coupling surface in the locking position and is selected from a number of locking pins having different flat heights to set a desired mechanical coupling device lash.

13 Claims, 5 Drawing Sheets

(56) References Cited

U.S. PATENT DOCUMENTS

| | | | | |
|---|---|---|---|---|
| 7,921,821 | B2 | 4/2011 | Rörig et al. | |
| 8,136,495 | B2 | 3/2012 | Seitz et al. | |
| 8,251,032 | B2 | 8/2012 | Manther | |
| 8,726,862 | B2 | 5/2014 | Zurface et al. | |
| 8,752,513 | B2 | 6/2014 | Zurface et al. | |
| 2003/0196621 | A1* | 10/2003 | Lichti | F01L 1/344 123/90.17 |
| 2007/0039573 | A1 | 2/2007 | Dierlein | |
| 2008/0245326 | A1* | 10/2008 | Gemein | F01L 1/185 123/90.16 |
| 2009/0114177 | A1 | 5/2009 | Manther et al. | |
| 2011/0226208 | A1 | 9/2011 | Zurface et al. | |
| 2012/0266835 | A1* | 10/2012 | Harman | F01L 1/185 123/90.39 |
| 2013/0255612 | A1 | 10/2013 | Zurface et al. | |

* cited by examiner

MECHANICAL LASH CONTROL FOR A SWITCHABLE ROLLER FINGER FOLLOWER

INCORPORATION BY REFERENCE

The following documents are incorporated by reference herein as if fully set forth: U.S. Provisional Patent Application No. 62/062,503, filed Oct. 10, 2014.

FIELD OF INVENTION

The invention relates to roller finger followers that are used in overhead cam-type internal combustion engines and, more particularly, to switchable roller finger followers that have a high lift and a low or no lift mode.

BACKGROUND

Switchable roller finger followers are known. See, for example, U.S. Pat. No. 7,174,869. Such finger followers have an outer lever pivotably mounted outside an inner lever and a roller rotatably mounted on a transverse axle in a slot in the inner lever. Here, the top surface of the outer lever can act as a contact surface for a high lift cam and the top surface of the roller acts as a contact surface for a low lift cam. A coupling element is mounted at one end of the finger follower and oil from an oil source is used to activate the coupling element. When the coupling element is activated, it locks the outer lever to the inner lever and requires the follower to follow the high lift cam and transfer the lift to the valve stem of an associated intake or exhaust valve. When the coupling element is deactivated, the outer lever is free to pivot relative to the inner lever, with the motion being absorbed by a lost-motion spring, and the motion of the low lift cam is transferred by the inner lever to the valve stem. This movement by the outer lever is conventionally referred to as the lost motion stroke.

Conventionally, the outer lever is a unitary structure such that the coupling element need only operate on one part of the outer lever. Typically, the coupling device operates on a yoke portion of the outer lever, the yoke portion being transverse to the longitudinal axis of the finger follower. Conventionally, the roller axle is staked to the inner lever to maintain its lateral position relative to the inner lever. U.S. Pat. No. 7,909,007 discloses a roller finger follower of this type. This provides a lost motion spring to maintain contact between the cam follower and the cam.

U.S. Pat. No. 8,251,032 discloses a prior switchable roller finger follower of one inventor in which two locking pins of the coupling device are extended outwardly to a locked position under each of outer arms via oil pressure, and are uncoupled via separate return springs when insufficient oil pressure is present. U.S. Pat. No. 8,251,032 is incorporated herein by reference as if fully set forth.

U.S. Pat. No. 8,726,862 and U.S. Pat. No. 8,752,513 disclose switchable finger followers with the coupling device formed by an actuatable locking pin having a flat that extends from the inner lever and engages under a stop surface on the outer lever. The locking pin is pre-assembled in the inner arm.

Switchable finger followers that provide for valve deactivation are also known in which the inner and outer levers are coupled together by a coupling element in the active state, and are uncoupled in the deactivated state, resulting in no lift being transferred to the valve stem.

One issue in these prior known adjusters is the lack of lash adjustment for the coupling element that connects the inner and outer levers in at least one operating state.

It would be desirable to provide a switchable finger follower of the general type noted above with simple manufacturing, as well as the possibility for adjusting the lash of the coupling element between the inner and outer levers.

SUMMARY

Briefly stated, a switchable roller finger follower having at least two lift modes for a valve train of an internal combustion engine is provided. The lift modes can be a no lift-lift mode or a low lift-high lift mode. The switchable roller finger follower includes an inner lever having first and second ends, preferably with a center recess in which a roller is mounted by a transverse axle as a cam contact surface. An outer lever is provided with two outer arms that extend along longitudinal sides of the inner lever, which may include slider pads as cam contact surfaces for a hi-lift—low-lift arrangement. The outer lever is mounted for pivoting movement at a first end of the inner lever by a pivot axle. A lost motion spring is connected between the inner lever and the outer lever. A coupling device is located on one of the inner lever or the outer lever on an end opposite from the pivot axle and includes a locking pin arranged to move in a longitudinal direction between a locking position, in which the inner lever and the outer lever are connected together for movement at least in an activation direction of a valve, and an unlocked position, in which the inner lever is pivotable relative to the outer lever. A coupling projection with a coupling surface and a stop surface is located on the other of the inner lever or the outer lever. The locking pin engages beneath the coupling surface in the locking position and a stop on the other of the inner lever or the outer lever contacts an opposing stop on the one of the inner lever or the outer lever. The locking pin includes a flat at a defined flat height that contacts the coupling surface in the locking position, wherein the locking pin is selected from a number of locking pins having different flat heights to set a desired mechanical coupling device lash. The surface of the locking pin flat can be angled, as illustrated in U.S. Pat. No. 7,055,479, or horizontal, with respect to the longitudinal axis of the pin. In addition to the locking pin flat height, the clearance between the locking pin outer diameter and its respective bore can also have an influence on the mechanical lash as this clearance is directly related to the magnitude of tilt of the locking pin. Therefore the selection process of the appropriate locking pin should consider this variable in the calculation of mechanical lash.

Preferably, the locking pin is made of hardened steel.

In one preferred arrangement, the switchable roller finger follower includes an anti-rotation and stop pin located in the housing that contacts the longitudinally extending flat and prevents rotation of the locking pin, and acts as a stop for the locking pin in the locking position.

In one arrangement, the coupling device of the switchable roller finger follower is located on the outer lever, and in the unlocked position, the roller finger follower provides zero lift.

In one arrangement, a cam follower roller is connected to the inner lever by a transverse axle, and forms the cam following surface.

In one preferred arrangement, the stop is located on the inner lever and is formed by ends of the transverse axle, and the opposing stop is formed by stop projections on the outer lever.

In another aspect, a method of adjusting a coupling device lash for a switchable roller finger follower, such as described above, is provided, and includes providing a switchable roller finger follower having at least two lift modes for a valve train of an internal combustion engine as described above. During assembly, the locking pin that is initially installed is a gage locking pin having a gage flat height set at a fixed dimension. A lash of the coupling device is then measured between the coupling surface and the flat of the gage locking pin in the locking position. After measuring, the gage locking pin is removed and a locking pin is selected with a flat height determined by using the measured lash from the gage locking pin, and the selected locking pin is then installed to provide a desired coupling device lash.

In one preferred further step, the lash of the coupling device is then measured to confirm that the lash is in a desired range. Preferably, the locking pin is selected with the flat height that results in the coupling device lash being in a range of 25 to 200 microns.

The assembly can then be completed by assembling a return spring, a washer, and a locking ring in the housing to retain the locking pin in position.

Preferably, an anti-rotation pin is also assembled in the housing that contacts the flat of the locking pin.

Other aspects of the invention are described below and in the claims, and have not been repeated here.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
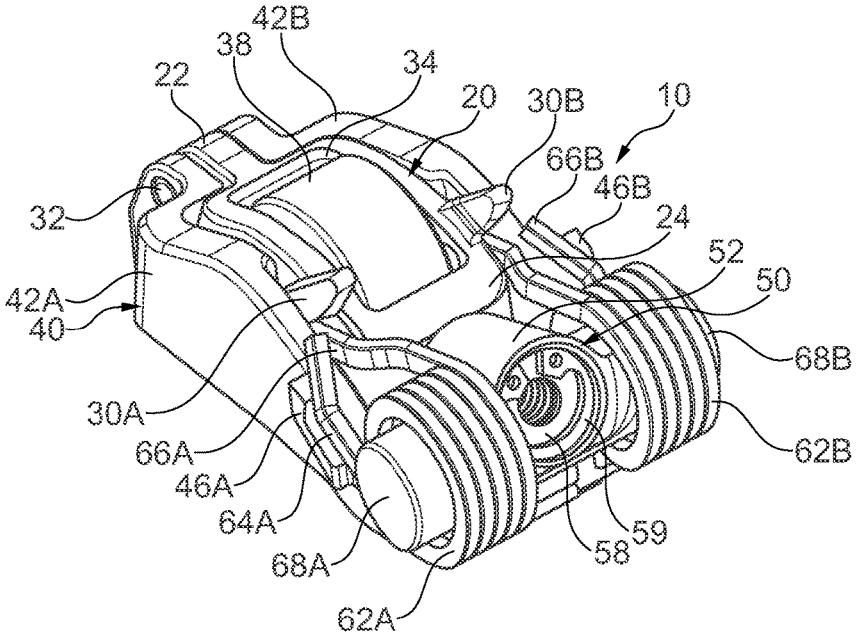
FIG. 1 is a perspective view of a switchable roller finger follower according to a first embodiment of the invention with no lift and lift modes of operation.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Figure 2:
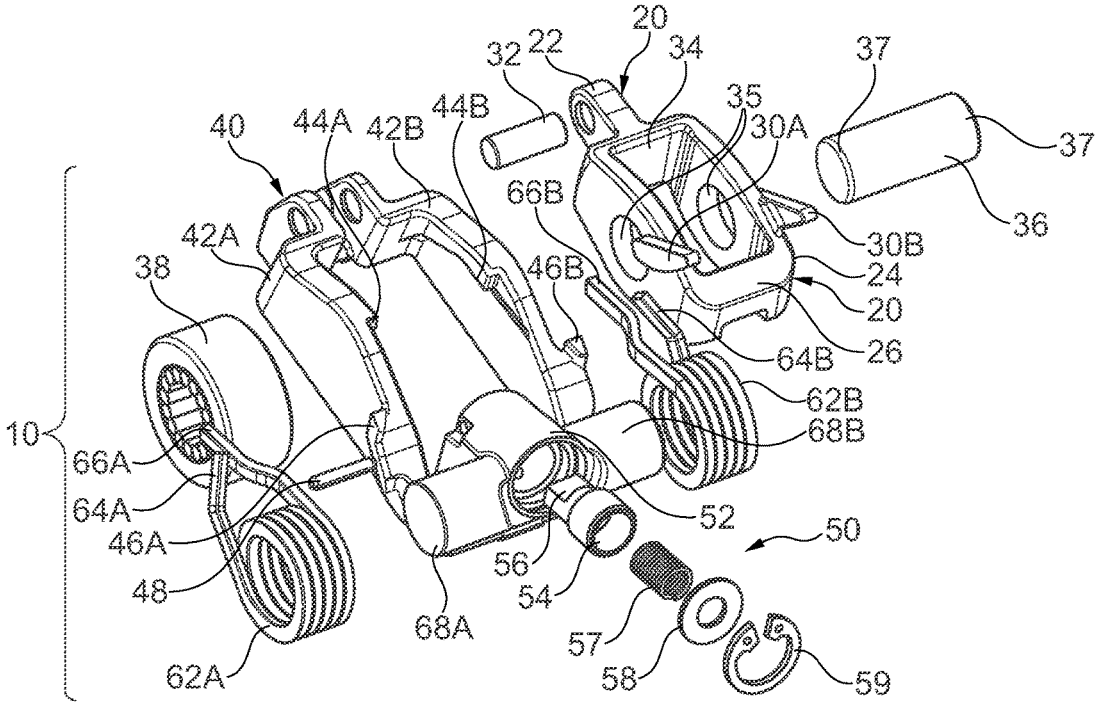
FIG. 2 is an exploded perspective view of the switchable roller finger follower of FIG. 1.

Referring to FIGS. 1 and 2, a preferred embodiment of the switchable roller finger follower 10 is shown. The switchable roller finger follower 10 has at least two lift modes of operation for a valve train of an internal combustion engine, not shown. In the illustrated embodiment of the switchable roller finger follower 10, the lift modes are a full lift mode and a lift mode which allows an associated valve to be deactivated depending upon the particular operating conditions for the engine.

The switchable roller finger follower 10 includes an inner lever 20 having a first end 22 and a second end 24. A center recess 34 is preferably provided in which a roller 38 is mounted by a transverse axle 36. However, the inner lever 20 could also just include a slider pad instead of a roller. As shown in detail in FIGS. 2-4, a coupling projection 26 is located on the second end 24 of the inner lever 20 and includes a coupling surface 27. Lost motion spring contact arms 30A, 30B are located on each side of the inner lever 20, as shown in FIGS. 1-4.

An outer lever 40 with two outer arms 42A, 42B that extend along longitudinal sides of the inner lever 20 is provided. The outer lever 40 is mounted for pivoting movement at the first end 22 of the inner lever 20 by a pivot axle 32. As shown in detail in FIGS. 1-4, the outer lever 40 includes lost motion spring catches 46A, 46B. Additionally, spring posts 68A, 68B are located at the second end of the outer lever 40 on which most lost motion springs 62A, 62B are installed as shown in detail in FIG. 1. These lost motion springs 62A, 62B include lower spring arms 64A, 64B that engage the lost motion spring catches 46A, 46B on the outer lever 40 as well as upper spring arms 66A, 66B which are engaged beneath the lost motion spring arms 30A, 30B on the inner lever 20. The lost motion springs 62A, 62B are configured to apply an upward force against the lost motion spring arms 30A, 30B on the inner lever 20 so that the inner lever 20 is biased upwardly so the roller 38 is at an upper most position.

Figure 3:
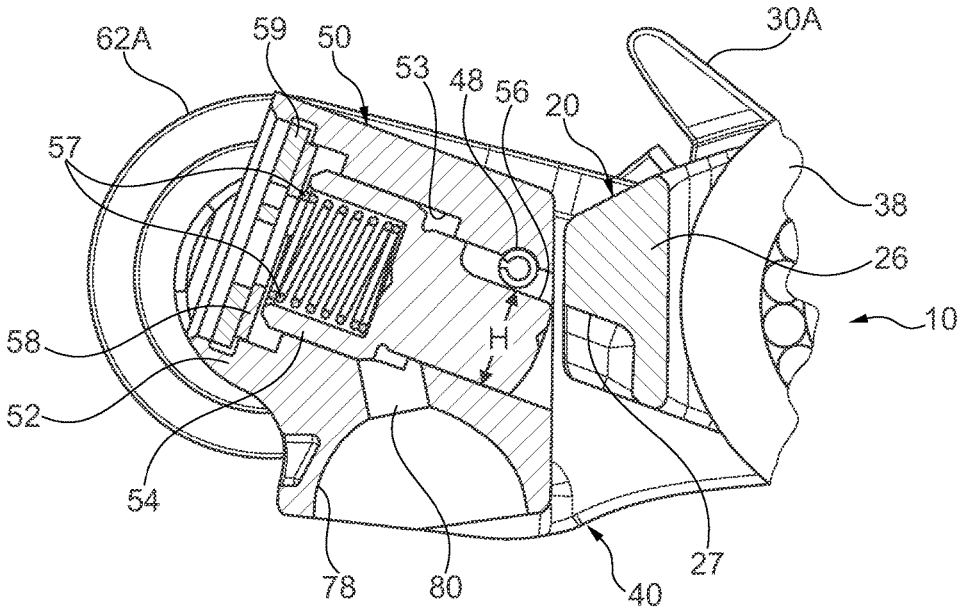
FIG. 3 is a partial cross-section view of the switchable roller finger follower of FIG. 1 taken through the coupling device shown in an unlocked position.
Figure 4:
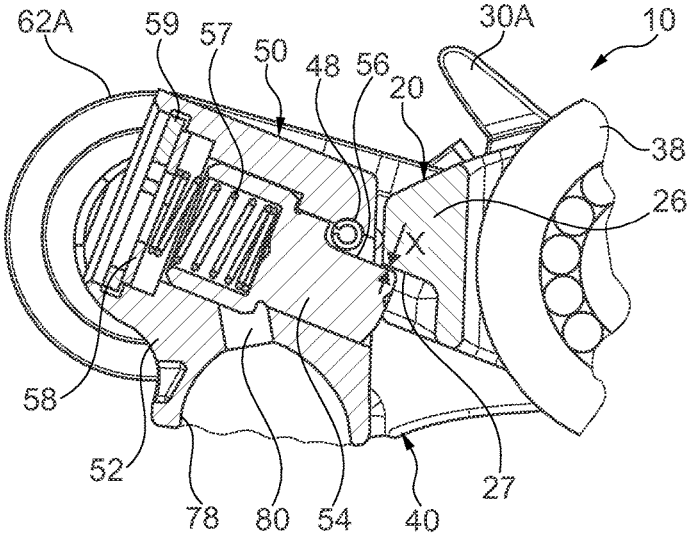
FIG. 4 is a partial cross-section view of the switchable roller finger follower of FIG. 1 taken through the coupling device shown in a locked position.
Figure 5:
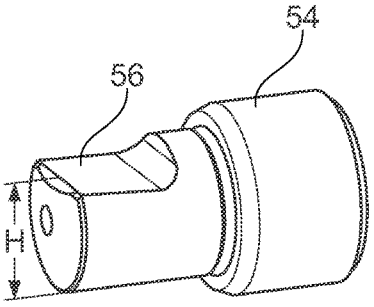
FIG. 5 is a detail perspective view of the locking pin used for lash adjustment.

A coupling device 50 is located on one of the inner lever 20 or the outer lever 40, and in the preferred embodiment, as shown in to FIGS. 1-4, the coupling device 50 is located on the outer lever 40 on an end opposite from the pivot axle 32. The coupling device 50 includes a locking pin 54 arranged to move in a longitudinal direction in a housing 52 between a locking position, shown in FIG. 4, in which the inner lever 20 and the outer lever 40 are connected together for movement at least in an activation direction of a valve, and an unlocked position, shown in FIG. 3, in which the outer lever 40 is pivotable relative to the inner lever 20. The coupling device 50 further includes a spring 57 which biases the locking pin 54 to the locked position as shown in FIG. 4. The spring 57 is held in position via a retainer washer 58 and a lock ring 59. The pin 54, spring 57, retainer washer 58, and snap ring 59 are all located within a stepped bore 53 (indicated in FIG. 3) in the housing 52 located on the second end of the outer arm 40. A socket 78 for receiving a support head which can be located on a lash adjusting device in the engine block or engine head is located on the bottom side of the outer lever 40. An oil passage 80 is located in the socket 78 and leads to the bore 53 in an area of a shoulder on the locking pin 54.

Figure 6:
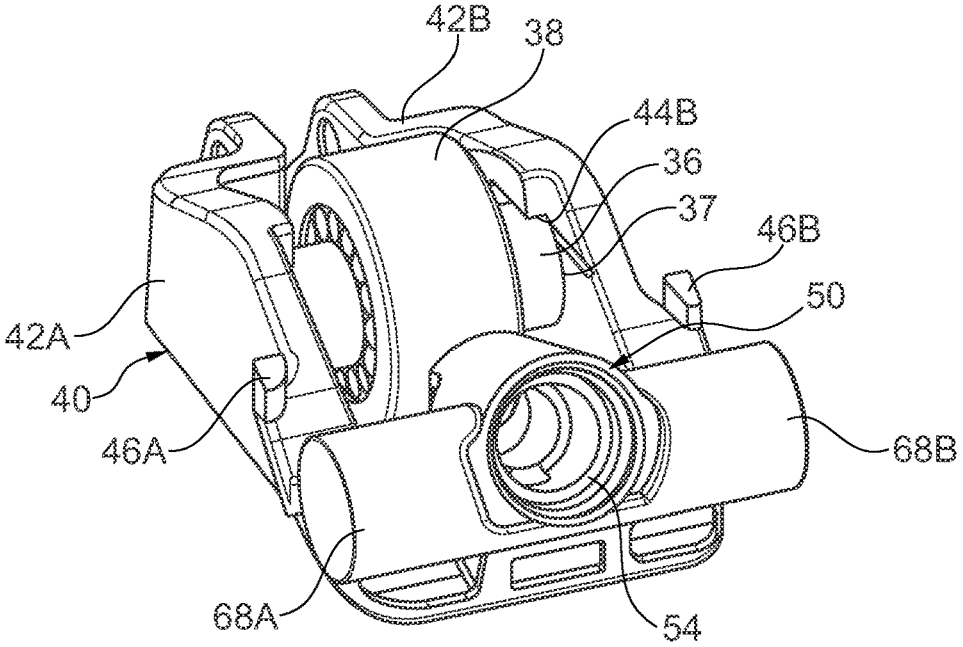
FIG. 6 is a perspective view of the outer lever, roller and transverse axle, with the inner lever removed, with ends of the transverse axle forming a transport end stop feature.
Figure 7:
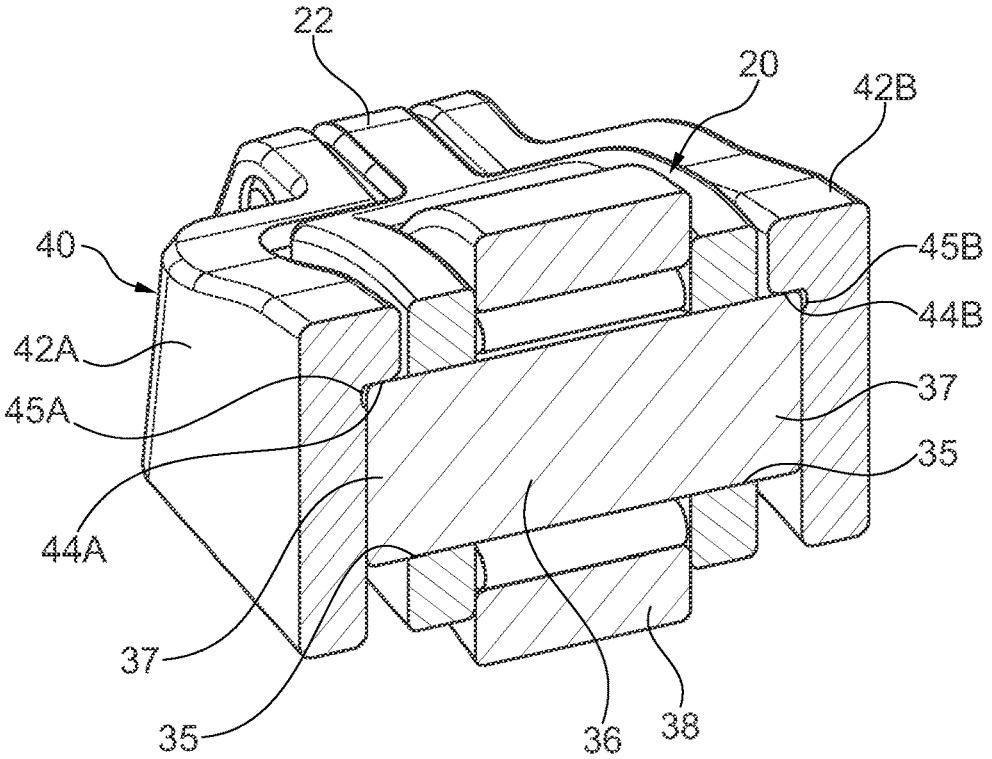
FIG. 7 is a perspective view, partially in cross-section, through the transport end stop feature in the locked, end position.

As shown in FIGS. 6 and 7, the transverse axle 36 for the roller 38 extends through the holes 35 in the sides of the inner lever 20 to form a stop on the inner lever 20 that contacts transport end stops 44A, 44B on the outer arms 42A, 42B of the outer lever 40 when the locking pin 54 is in the locked position. As shown in FIG. 7, undercuts 45A, 45B are formed between the inner walls of the outer lever 40 and the transport end stops 44A, 44B to allow the ends 37 of the transverse axle 36 to fully contact the transport end stops 44A, 44B.

As shown in FIGS. 2-5, the locking pin 54 includes a flat 56 at a defined flat height (indicated as H in FIGS. 3 and 5) that contacts the coupling surface 27 in the locking position (shown in FIG. 4). An anti-rotation and stop pin 48, shown in FIGS. 2-4, is located in the housing 52 that contacts the longitudinally extending flat 56 and prevents rotation of the locking pin 54, and acts as a stop for the locking pin 54 in the locking position, as shown in FIG. 4. Preferably, the locking pin 54 is made of hardened steel.

Figure 9A:
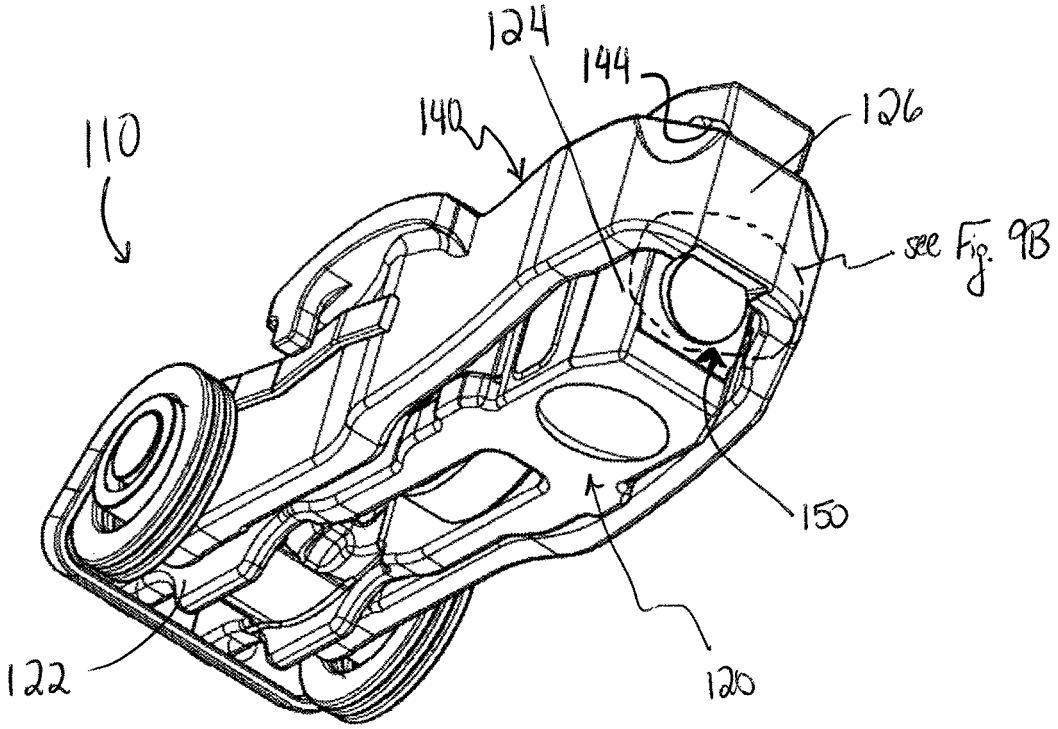
FIG. 9A is a perspective view of a switchable roller finger follower according to another embodiment of the invention.
Figure 9B:
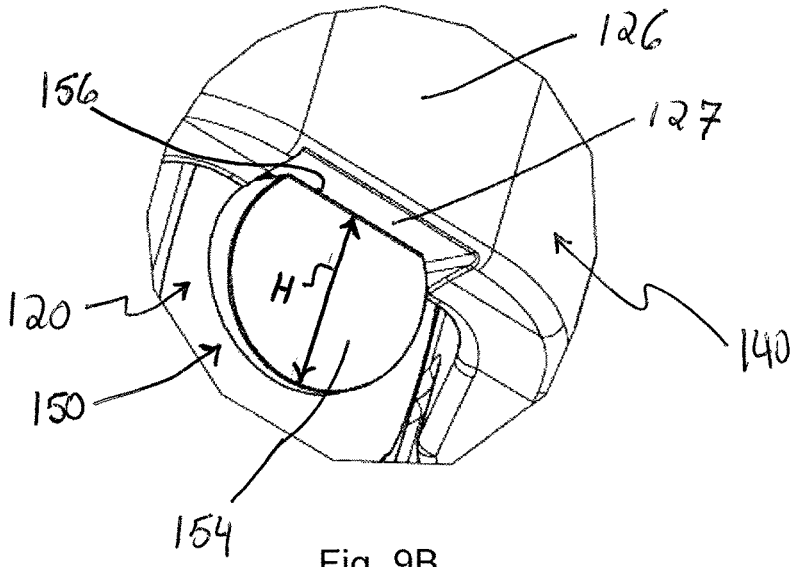
FIG. 9B is a detailed partial view of FIG. 9A.

Referring to FIGS. 9A and 9B, another embodiment of the switchable roller finger 110 is shown with a coupling device 150 located on the inner lever 120. This embodiment is otherwise similar to the preferred embodiment, and like parts are labeled with like reference numerals. The coupling device 150 includes a locking pin 154 arranged to move in a housing in a longitudinal direction between a locking position (shown in FIGS. 9A and 9B), in which the inner lever and the outer lever are connected together for movement at least in an activation direction of a valve, and an unlocked position, in which the outer lever is pivotable relative to the inner lever. A coupling projection 126 with a coupling surface 127 is located on the outer lever 140, the locking pin 154 engages beneath the coupling surface in the locking position and a stop 144 on the inner lever 120 contacts an opposing stop on the outer lever. The locking pin 154 includes a flat 156 at a defined flat height (indicated as H in FIG. 9B).

In the embodiment of the switchable roller finger follower 10 shown in FIGS. 1-4, oil pressure applied via the oil passage 80 acts on the shoulder on the locking pin 54 in order to move the pin 54 against this force of the spring 57 into an unlocked position (shown in FIG. 3) which allows the inner lever 20 to move up and down relative to the outer lever about the pivot axle 32, deactivating the valve associated with the finger lever 10.

Figure 8A:
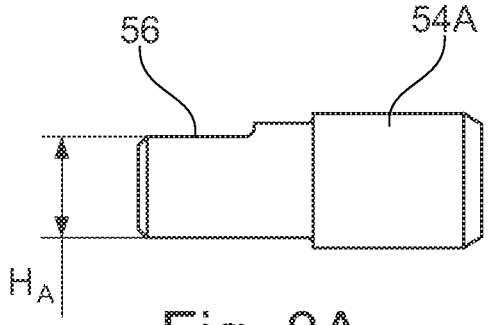
FIGS. 8A-8C show three locking pins having different flat heights.
Figure 8B:
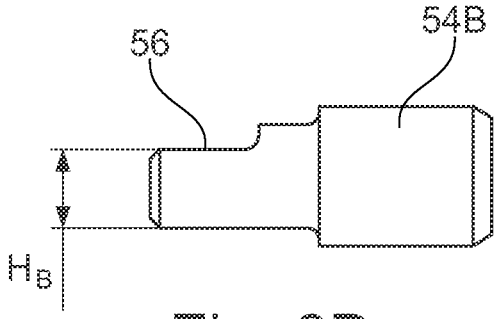
Figure 8C:
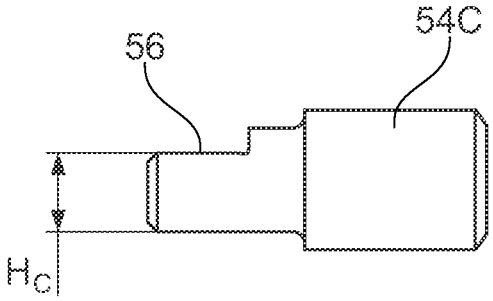

As shown in FIG. 4, the lash X between the coupling projection 26 on the inner lever 20 and the locking pin 54 is preferably in the range of 25 to 200 microns for most motor vehicle applications in order to provide optimum functioning. The noted range is considered exemplary, and is not limiting as this could vary depending upon the particular application. The lash X often needs to be adjusted after assembly and/or during installation in order to meet the desired or required measurement range. In the present case, the locking pin 54 is selected from a number of locking pins, such as 54A, 54B, 54C shown in FIGS. 8A-8C, having different flat heights $H_A$, $H_B$, $H_C$ to set a desired mechanical coupling device lash X.

A method of adjusting a coupling device lash for a switchable roller finger follower 10 is also provided. The method includes providing a switchable roller finger follower 10 having at least two lift modes for a valve train of an internal combustion engine, as described above. In accordance with the method, the locking pin 54 that is initially installed is a gage locking pin having a gage flat height H set at a fixed dimension. A lash X of the coupling device 50 between the coupling surface 27 and the flat 56 of the gage locking pin 54 is measured in the locking position (shown in FIG. 4). The gage locking pin 54 is then removed, a locking pin such as 54A, 54B, 54C (shown in FIGS. 8A-8C) is selected with a flat height, for example $H_A$, $H_B$, $H_C$, that is determined by using the measured lash X from the gage locking pin 54. The locking pin 54A, 54B, 54C is selected to provide a desired coupling device lash X within a predetermined range.

Once selected and installed, the lash X of the coupling device is measured in order to confirm that the lash X is in a desired range. Preferably, the locking pin 54A, 54B, 54C is selected with the flat height $H_A$, $H_B$, $H_C$, that results in the coupling device lash X being in a range of 25 to 200 microns.

Once this is confirmed, the return spring 57, a washer 58, and a locking ring 59 are inserted behind the locking pin 54 in the housing 52 to retain the locking pin 54 in position. Preferably, the anti-rotation pin 48 is also installed in the housing 52 and contacts the flat 56 of the locking pin 54.

While the preferred embodiment of the invention has been described in detail, those skilled in the art will recognize that other changes could be made to a switchable roller finger follower without departing from the scope of the present invention. Other types of coupling arrangements could be provided and the specific configuration of the inner lever and outer arms could be varied without departing from the scope of the present invention. Accordingly, the scope of the invention should not be limited by the preferred embodiments discussed above and instead should be defined by the claims as noted below.

What is claimed is:

1. A switchable roller finger follower having at least two lift modes for a valve train of an internal combustion engine, comprising:

an inner lever having first and second ends;

an outer lever with two outer arms that extend along longitudinal sides of the inner lever, mounted for pivoting movement at the first end of the inner lever by a pivot axle;

a lost motion spring connected between the inner lever and the outer lever;

a coupling device located on one of the inner lever or the outer lever on an end opposite from the pivot axle that includes a locking pin arranged to move in a housing in a longitudinal direction between a locking position, in which the inner lever and the outer lever are connected together for movement at least in an activation direction of a valve, and an unlocked position, in which the outer lever is pivotable relative to the inner lever;

a coupling projection with a coupling surface located on the other of the inner lever or the outer lever, the locking pin proximate the coupling surface in the locking position and a stop on the other of the inner lever or the outer lever contacts an opposing stop on the one of the inner lever or the outer lever; and the locking pin includes a flat at a defined flat height that sets a mechanical coupling device lash in a range of 25 to 200 microns.

2. The switchable roller finger follower of claim 1, wherein the locking pin is made of hardened steel.

3. The switchable roller finger follower of claim 1, further comprising an anti-rotation and stop pin located in the housing that contacts the longitudinally extending flat and prevents rotation of the locking pin, and acts as a stop for the locking pin in the locking position.

4. The switchable roller finger follower of claim 1, wherein the coupling device is located on the outer lever, and in the unlocked position, the roller finger follower provides zero lift.

5. The switchable roller finger follower of claim 4, further comprising a cam follower roller connected to the inner lever by a transverse axle.

6. The switchable roller finger follower of claim 5, the stop is located on the inner lever and is formed by ends of the transverse axle, and the opposing stop is formed by stop projections on the outer lever.

7. A method of adjusting a coupling device lash for a switchable roller finger follower, comprising:

providing a switchable roller finger follower having at least two lift modes for a valve train of an internal combustion engine, including an inner lever having first and second ends, an outer lever with two outer arms that extend along longitudinal sides of the inner lever, mounted for pivoting movement at the first end of the inner lever by a pivot axle, a lost motion spring connected between the inner lever and the outer lever, a coupling device located on one of the inner lever or the outer lever on an end opposite from the pivot axle that includes a locking pin arranged to move in a housing in a longitudinal direction between a locking position, in which the inner lever and the outer lever are connected together for movement at least in an activation direction of a valve, and an unlocked position, in which the outer lever is pivotable relative to the inner lever, a coupling projection with a coupling surface located on the other of the inner lever or the outer lever, the locking pin proximate to the coupling surface in the locking position and a stop on the other of the inner lever or the outer lever contacts an opposing stop on the one of the inner lever or the outer lever, and the locking pin includes a flat at a defined flat height that contacts the coupling surface in the locking position, wherein the locking pin is a gage locking pin having a gage flat height set at a fixed dimension;

measuring a lash of the coupling device between the coupling surface and the flat of the gage locking pin in the locking position;

removing the gage locking pin; and selecting a locking pin with a flat height determined by using the measured lash from the gage locking pin, and installing the selected locking pin to provide a desired coupling device lash.

8. The method of claim 7, further comprising measuring the lash of the coupling device and confirming that the lash is in a desired range.

9. The method of claim 8, wherein the locking pin is selected with the flat height that results in the coupling device lash being in a range of 25 to 200 microns.

10. The method of claim 7, further comprising assembling a return spring, a washer, and a locking ring in the housing to retain the locking pin in position.

11. The method of claim 7, further comprising assembling an anti-rotation pin in the housing that contacts the flat of the locking pin.

12. A switchable roller finger follower assembly having at least two lift modes for a valve train of an internal combustion engine, comprising:

a plurality of locking pins, each of the plurality of locking pins having a flat at a different defined flat height;

an inner lever having first and second ends;

an outer lever with two outer arms that extend along longitudinal sides of the inner lever, mounted for pivoting movement at the first end of the inner lever by a pivot axle;

a lost motion spring connected between the inner lever and the outer lever;

a coupling device located on one of the inner lever or the outer lever on an end opposite from the pivot axle that includes a selected locking pin of the plurality of locking pins arranged to move in a housing in a longitudinal direction between a locking position, in which the inner lever and the outer lever are connected together for movement at least in an activation direction of a valve, and an unlocked position, in which the outer lever is pivotable relative to the inner lever;

a coupling projection with a coupling surface located on the other of the inner lever or the outer lever, the selected locking pin positioned along the coupling surface in the locking position and a stop on the other of the inner lever or the outer lever contacts an opposing stop on the one of the inner lever or the outer lever; and the flat of the selected locking pin contacts the coupling surface in the locking position and sets a desired mechanical coupling device lash.

13. The switchable roller finger follower assembly of claim 12, further comprising a gage locking pin having a gage flat height set at a fixed dimension for measuring lash.

* * * * *